US007250942B2

(12) United States Patent
Mitsumura et al.

(10) Patent No.: US 7,250,942 B2
(45) Date of Patent: Jul. 31, 2007

(54) DISPLAY APPARATUS AND METHOD OF CONTROLLING DISPLAY APPARATUS

(75) Inventors: Satoshi Mitsumura, Kanagawa (JP); Kazuaki Sugai, Kanagawa (JP); Atsushi Sakakibara, Kanagawa (JP); Yoshikazu Shibamiya, Tokyo (JP); Eisaku Tatsumi, Kanagawa (JP); Kenzo Ina, Kanagawa (JP); Osamu Iketa, Kanagawa (JP); Tomoko Maruyama, Kanagawa (JP); Kazumi Suga, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 626 days.

(21) Appl. No.: 10/793,790

(22) Filed: Mar. 8, 2004

(65) Prior Publication Data

US 2004/0196273 A1 Oct. 7, 2004

(30) Foreign Application Priority Data

Mar. 7, 2003 (JP) ..... 2003-061989

(51) Int. Cl.
*G09G 5/00* (2006.01)

(52) U.S. Cl. ..... 345/204; 345/214

(58) Field of Classification Search ..... 345/1.1–3.4, 345/156, 157–176, 178, 179, 180, 204, 205, 345/206, 207, 214
See application file for complete search history.

(56) References Cited

U.S. PATENT DOCUMENTS 5,644,653 A 7/1997 Sunakawa et al. ..... 382/187
5,936,619 A 8/1999 Nagasaki et al. ..... 345/205
6,100,872 A 8/2000 Aratani et al. ..... 345/147
6,184,859 B1 * 2/2001 Kojima ..... 345/629
6,310,662 B1 10/2001 Sunakawa et al. ..... 348/747
6,415,138 B2 * 7/2002 Sirola et al. ..... 455/90.1
6,700,587 B1 3/2004 Hasegawa et al. ..... 345/600
7,007,168 B2 * 2/2006 Kubo et al. ..... 713/183
2003/0095110 A1 * 5/2003 Ukita et al. ..... 345/173
2003/0132928 A1 * 7/2003 Kori ..... 345/204
2005/0168441 A1 * 8/2005 Obitsu et al. ..... 345/157

FOREIGN PATENT DOCUMENTS

JP 2002-229546 * 8/2002

* cited by examiner

*Primary Examiner*—Nitin I. Patel
(74) *Attorney, Agent, or Firm*—Fitzpatrick, Cella, Harper & Scinto

(57) ABSTRACT

A display apparatus of the invention which detects an obstacle put on a display unit, and modifies a place or manner of a display to be performed, comprising the display unit having a display surface; a detecting unit for detecting a display-obstructed area on the display surface where a display-obstructing factor is present; a shifting unit for shifting the area of displayed contents to a displayable area other than the display-obstructed area, when the display-obstructed area is detected; and a display control unit for displaying the displayed contents shifted by the shifting unit in the area other than the display-obstructed area.

7 Claims, 13 Drawing Sheets

DISPLAY APPARATUS AND METHOD OF CONTROLLING DISPLAY APPARATUS

BACKGROUND OF THE INVENTION

1. Field of the Invention

The present invention relates to a display apparatus in which a display surface is placed horizontally and a method of controlling the display apparatus.

2. Description of the Related Art

There is proposed an apparatus storing a horizontally disposed display screen for supporting an usage as a business table, wherein the user can display electronic documents at desired positions by using a tool such as an electronic pen.

According to the aforementioned technology, when working with documents or tools, or having a meeting on a table in which the display screen is stored in a general way, if an object is placed on the table, the electronic documents displayed on the display is covered partly or completely by the object and hence the user cannot view the electronic documents.

However, there are many cases where documents or tools are used on the table. For example, when the user is working alone or having a meal, at the table, or when a plurality of persons are working at the table while having a meal, having a conversation, or chattering, there are cases in which objects are placed on the display stored in the table. In such cases, if such objects are detected and display is effected at the position which is not covered by obstacles, the user can view the display screen anytime without searching for.

SUMMARY OF THE INVENTION

In view of such circumstances, it is an object of the invention to provide a display control apparatus capable of detecting an obstacle placed on a display unit, if at all, and changing the position of display or the form of display, and a method of controlling the same.

To achieve the above-described object, the present invention provides a display apparatus comprising:

a display unit having a display surface;

a detecting unit for detecting a display-obstructed area on the display surface where a display-obstructing factor is present;

a shifting unit for shifting the area of displayed contents to a displayable area other than the display-obstructed area, when the display-obstructed area is detected; and a display control unit for displaying the displayed contents shifted by the shifting unit in the area other than the display-obstructed area.

A method of controlling a display apparatus according to the invention is a method of controlling a display apparatus for effecting display in the area on the display apparatus in which no display-obstructing factor is present, including the steps of:

detecting a display-obstructed area where the display-obstructing factor is present when there is the display-obstructing factor placed on the display apparatus;

shifting the area of displaying displayed contents to a displayable area other than the display-obstructed area when the display-obstructed area is detected; and displaying the area of the displayed contents shifted by the shifting u nit to the area other than the display-obstructed area.

A method of controlling a display apparatus according to the invention is a method of controlling a display apparatus including the steps of:

displaying displayed contents on a display surface;

detecting a display-obstructing factor existing on the display surface; and specifying a displayable area according to the display-obstructed area where the display-obstructing factor exists and shifting the displayed contents to the displayable area.

In the above-described structure, even when an obstacle that may become the display-obstructing factor is placed on the display apparatus, the display-obstructed area where the display-obstructing factor is present is detected and the area of the displayed contents (image, video) can be shifted to and displayed in the displayable area other than the display-obstructed area. Therefore, the displayed contents covered by the display-obstructing obstacle can be displayed at the position where the user can view without change, or by changing the display mode such as in a reduced size, or in a state magnified by different scale factors in vertical and horizontal directions.

DETAILED DESCRIPTION OF THE PREFERRED EMBODIMENTS

Figure 1:
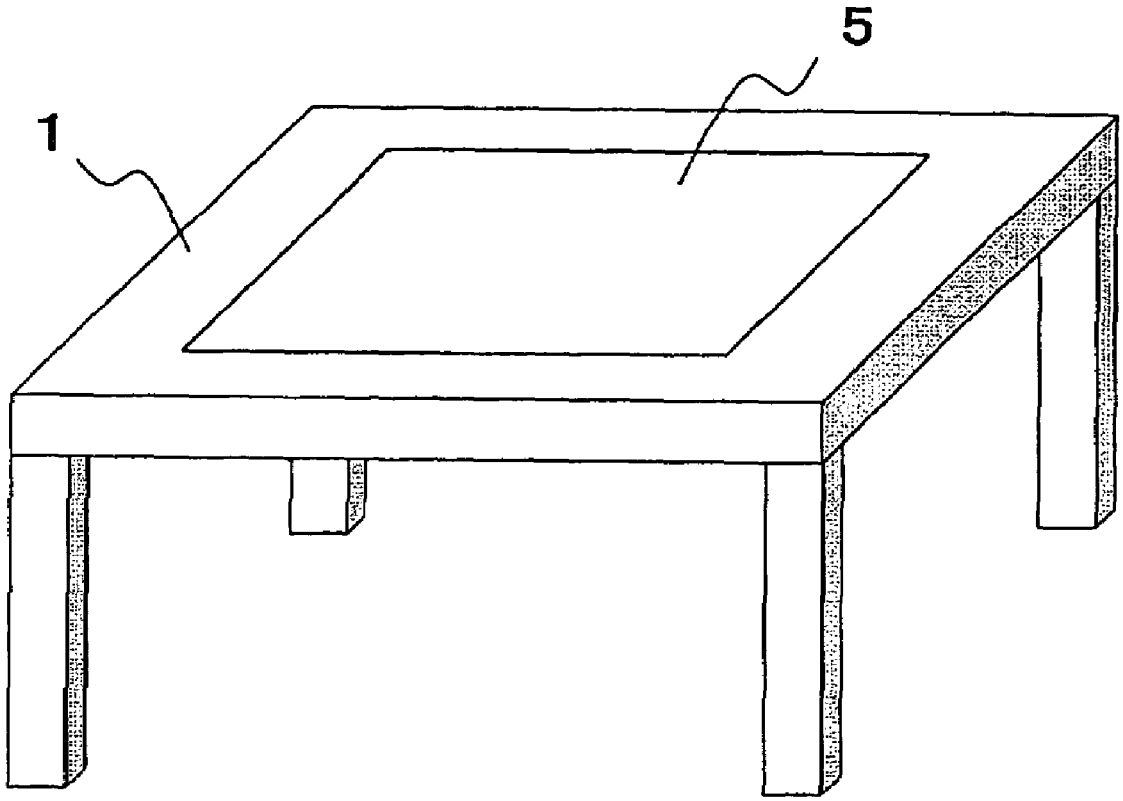
FIG. 1 is an appearance perspective view of the display unit constituting a display apparatus according to a first embodiment of the invention.

Referring now to the drawings, preferred embodiments of the invention will be described in detail by way of illustration. The sizes, the materials, the shapes, and the relative layouts of components stated in the following embodiments are not intended to limit the scope of the invention unless otherwise specified, and the materials and the shapes of members in the following description are the same as those described in this specification for the first time unless otherwise specified.

First Embodiment

Referring now to FIG. 1 to FIG. 6, a first embodiment of the invention will be described.

FIG. 1 is an appearance perspective view of a display unit constituting a display apparatus according to the present embodiment. In FIG. 1, reference numeral 1 designates a table arranged so that the upper surface thereof is horizontal, and a display 5 is provided on the upper surface of the table 1. The display apparatus includes a coordinate indicator unit as detection and input means for detecting the presence of an obstacle and entering the coordinates thereof.

Figure 2:
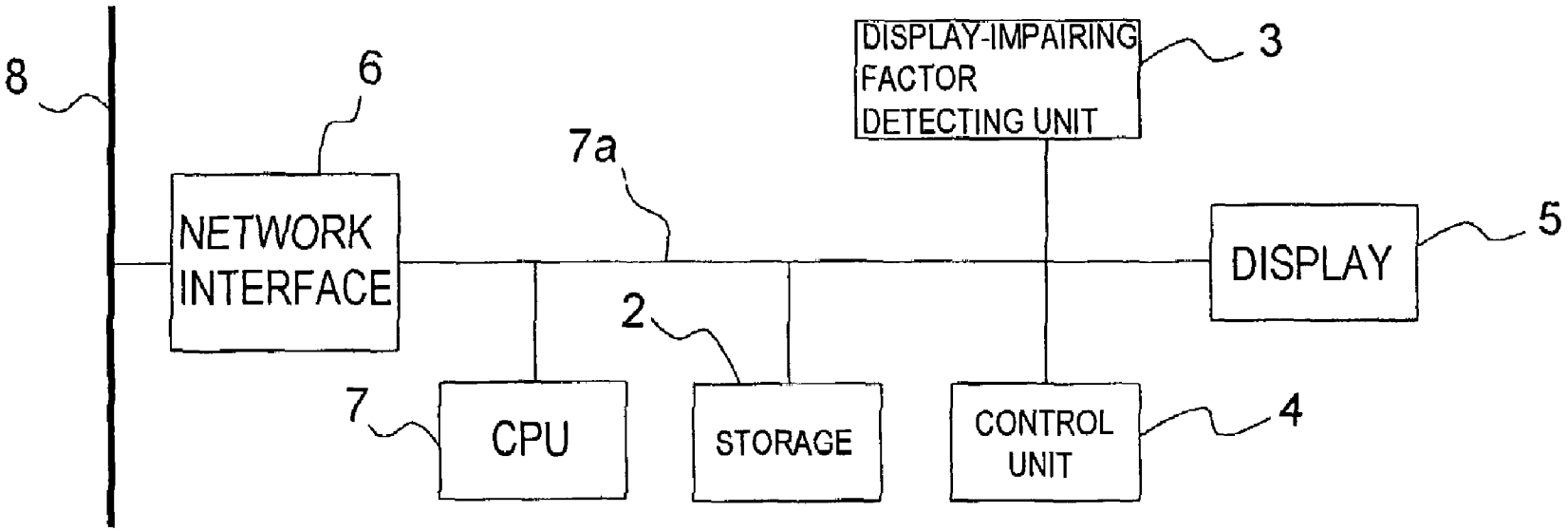
FIG. 2 is a block diagram showing a system configuration of the display apparatus displaying an electronic information image according to the first embodiment of the invention.

FIG. 2 is a block diagram showing a system configuration of the display apparatus for displaying an electronic information image according to the present embodiment.

In FIG. 2, the display apparatus includes the aforementioned display 5, an display-obstructing factor detecting unit 3 built in a display surface for detecting information entered by the coordinate indicator unit as a display-obstructing factor when a display-obstructing obstacle is placed on the display surface, a control unit 4 having a circuit capable of controlling the coordinate indication, a central processing unit (CPU) 7 for controlling the entire apparatus, a storage unit 2 including a memory for storing a program for executing a processing described later in advance, such as a read only memory (ROM) and a memory for storing image data or the like to be displayed on the display 5 temporarily, such as a random access memory (RAM), and a network interface 6 for connecting the display apparatus with other devices or networks.

The control unit 4, the CPU 7, the storage unit 2, the display 5, the display-obstructing factor detecting unit 3, and the network interface 6 are connected with each other via a bus 7*a*. The control unit 4, the CPU 7, the storage unit 2, and the network interface 6 are provided on the main body of the display apparatus, which is not shown in FIG. 1. The display apparatus can be connected to a local area network (LAN) 8 via the network interface 6.

The display-obstructing factor detecting unit 3 is provided in the display surface of the display 5 so as not to obstruct display thereof. A coordinate indicator unit, not shown, provided in the display-obstructing factor detecting unit 3 is connected to the display-obstructing factor detecting unit 3 via a coordinate indication control circuit, not shown, mounted to the control unit 4, and generates an induced voltage in a predetermined coil in an X-axis coil group and a Y-axis coil group by means of an oscillation circuit, not shown, when a switch provided on the display-obstructing factor detecting unit 3 for detecting contact of a display-obstructing obstacles is turned on. The display-obstructing factor detecting unit 3 is configured to detect the generated induced voltage by an X-axis receiving circuit and a Y-axis receiving circuit, recognize a frequency outputted from the coordinate indicator unit for comparing and calculating the amplitude of the induced voltage, and detect coordinates of the position and the size of the display-obstructing obstacle.

In other words, the display-obstructing factor detecting unit 3 recognizes the frequency outputted from the coordinate indicator unit, not shown, and identifies where the detected display-obstructing obstacle is located on the coordinate and how large it is.

The display 5 includes an area where all the user of the table can place objects (display-obstructed area) on the table and an area which is determined that no obstacles are placed on the table by the users (displayable area).

The coordinate indicator unit directly identifies the area where the obstacle is present and the area where no obstacle is present, and shifts the electronic information image to the displayable area, or calls up a file stored in a separate computer (not shown) connected to the LAN 8 to the displayable area using the result of the identification by the coordinate indicator unit. Information about the display-obstructing obstacle supplied from the coordinate indicator unit or information about the file read out from the separate computer is temporality stored in the storage unit 2, and displayed on the display 5 under control of the CPU 7.

Figure 3:
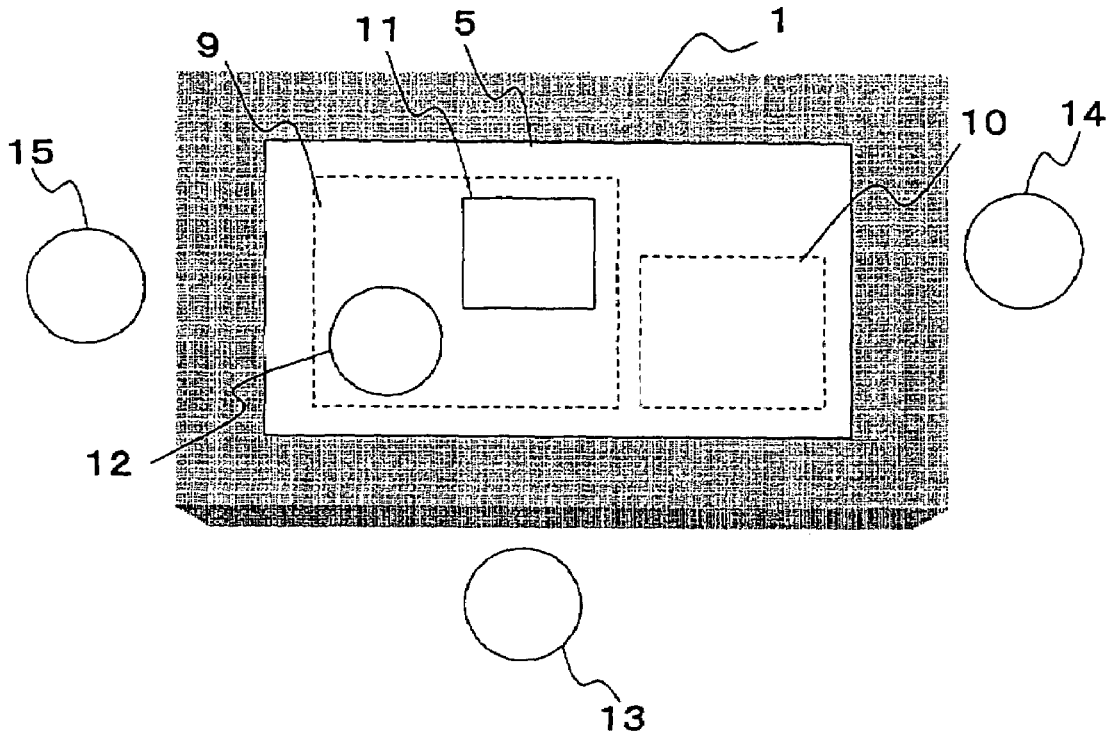
FIG. 3 is an explanatory drawing showing a state in which the users are working or having a conversation at the table using the display apparatus.

FIG. 3 is an explanatory drawing showing that a plurality of users are working, having a conversation or a conference at the table using the above-described display apparatus. In FIG. 3, reference numerals 13, 14 and 15 designate users around the table. On the display surface of the display 5, a display-obstructed area 9 in which the user places obstacles 11, 12 on the table, and a displayable area 10 in which no obstacle is present are identified distinctively.

The electronic information image is displayed on the display surface of the display 5 based on the identification of these areas, and the positions of the areas can be changed by the process of shifting the electronic information image in the area where no display-obstructing obstacle is present.

Figure 4:
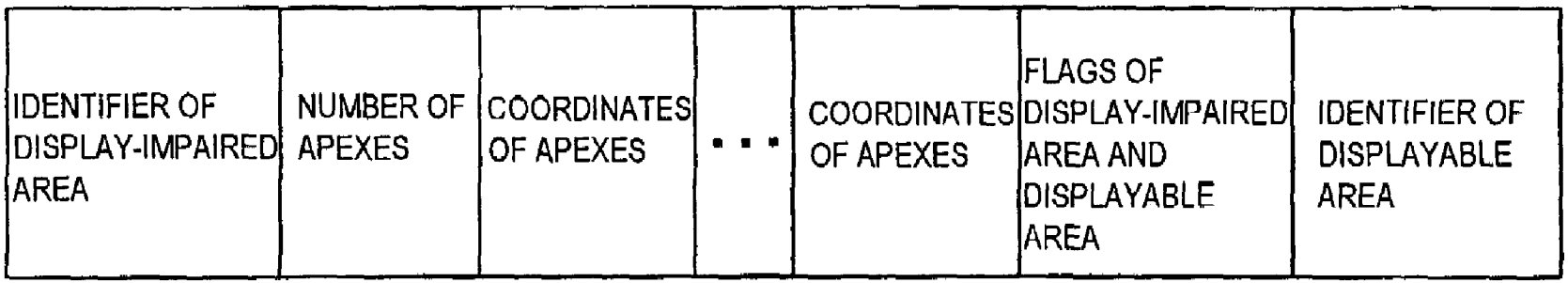
FIG. 4 is a drawing showing an example of coordinate information stored in a storage unit 2 in a coordinate format.

Information on the areas (coordinate information) is stored in the storage unit 2 in a coordinate format, and is coordinated with coordinate input identifiers of the display-obstructing obstacles. FIG. 4 is a drawing showing an example of the above-described coordinate information stored in the storage unit 2 in the coordinate format. One record of coordinate information for executing identification includes an identifier of the area, the number of apexes showing the shape of the area, coordinates of the respective apexes, a flag showing whether the area is an area where an obstacle is present or an area where no obstacle is present, and an identifier for identifying the display-obstructing obstacle when an obstacle is present in that specific area.

When the user of the table brings an obstacle into contact with the display surface of the display 5, the display-obstructing factor detecting unit 3 obtains coordinate information of the area including the coordinates of the position of the contact area. The CPU 7 searches the storage unit 2 based on the coordinate and obtains coordinates information about the area including the coordinate of the contact area. The CPU 7 references the obtained coordinate information and identifies the area including the coordinates of the detected position as the display-obstructed area, that is, the area where the obstacle is present. When it is determined that the detected coordinate is included in the area where the obstacle is present, the input of coordinate indication is determined to be effective, and the CPU 7 shifts the electronic information image to the area where no obstacle is present, that is, the area where no display-obstructing obstacle is in contact with the display surface, or displays the electronic information image in reduced size. At the same time, since the input is ineffective when the detected coordinate is included in the area where the obstacle is present, display in this area is deleted.

Figure 5:
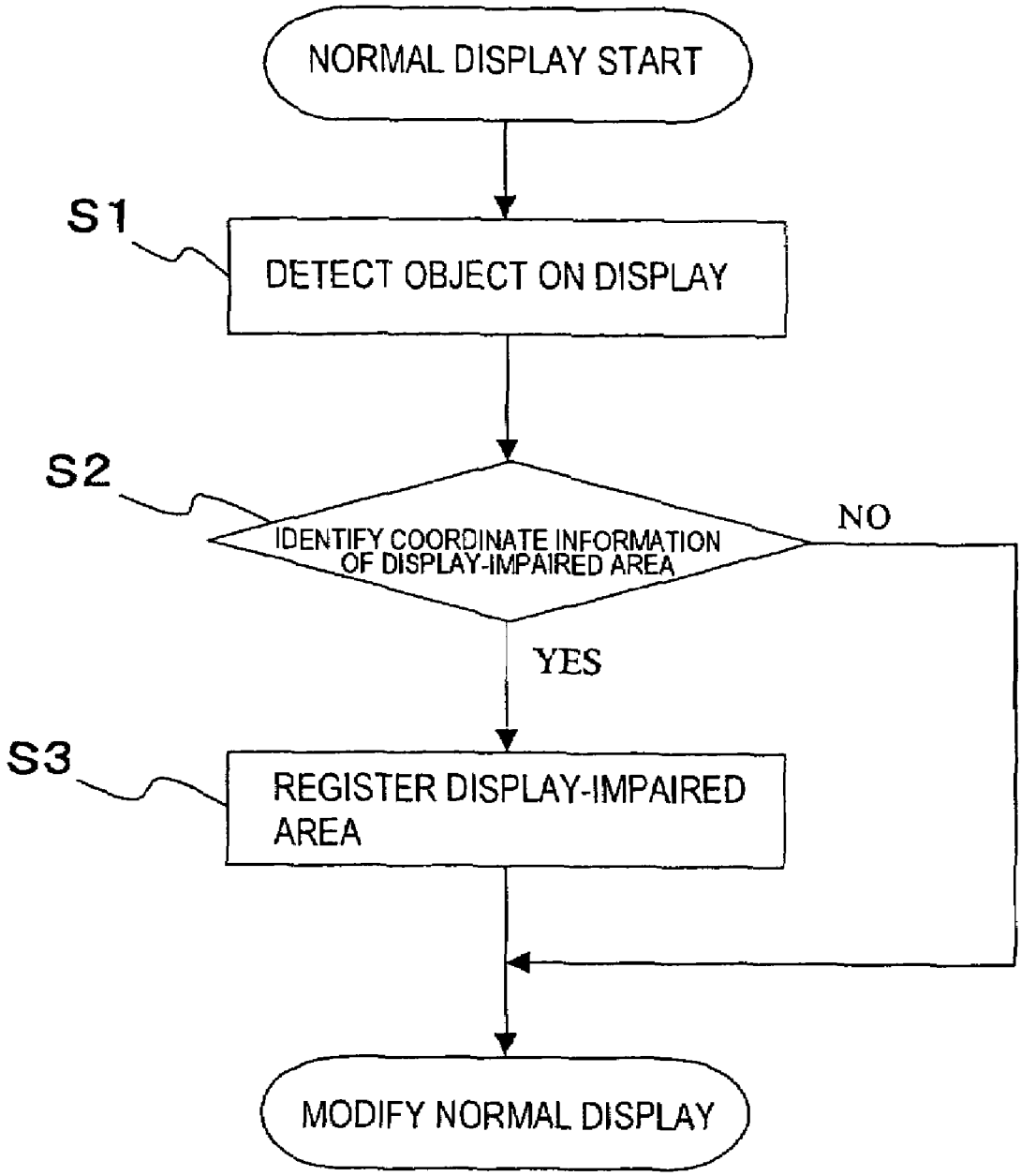
FIG. 5 is a flowchart showing a procedure performed by the user for coordinating the area in which things are placed on the display surface with a coordinate indicator unit provided in the display surface.

FIG. 5 is a flowchart showing a procedure of coordinating the area on the display surface where the user placed the obstacle with the coordinate indicator unit provided in the display surface. Described below are the case of effecting display and the case of turning off display as a result of determination of the area on the display surface where an obstacle is placed by the user of the table provided with the coordinate indicator unit.

In the initial state, the coordinate information in the storage unit 2 includes position coordinates representing all the coordinates in the display area on the display 5 so that the area in which the obstacle is present and the area in which no obstacle is present, shown in FIG. 3, can be identified. The coordinate information is configured in such a manner that a flag indicating that no obstacle is present in the area is put to the coordinate information relating the area which is not the display-obstructed area (that is, displayable area), and a flag indicating that the area is the display-obstructed area is put to the coordinate information relating the display-obstructed area.

In this state, for example, when an user 13 of the table places an object on the display 5 and brings the object into contact with the display surface, the display-obstructing factor detecting unit 3 detects that there is an obstacle based on an input from the coordinate indicator unit (Step S1), and then, information indicating that there is input from the coordinate indicator unit and coordinate information about the area including the detected coordinate are transmitted to the CPU 7. The CPU 7 determines whether or not the display-obstructed area identified and entered by the coordinate indicator unit already exists based on the received coordinate information (Step S2). When it is determined that the detected display-obstructed area is small enough to be ignored, the procedure is terminated. When it is determined that the detected display-obstructed area is too large to ignore, an identifier indicating the coordinate indicator unit is registered as an identifier (FIG. 4) of information relating the display-obstructed area 9 (Step S3).

When coordination between detection of the obstructing factor and the display-obstructed area is completed in the present display apparatus, the displayable area 10 on the display 5 can display the image at any position. However, when the display-obstructed area is detected by the display-obstructing factor detecting unit 3, the image in the display-obstructed area on the display surface, where the user places an object, is shifted to the area other than the display-obstructed area.

Figure 6:
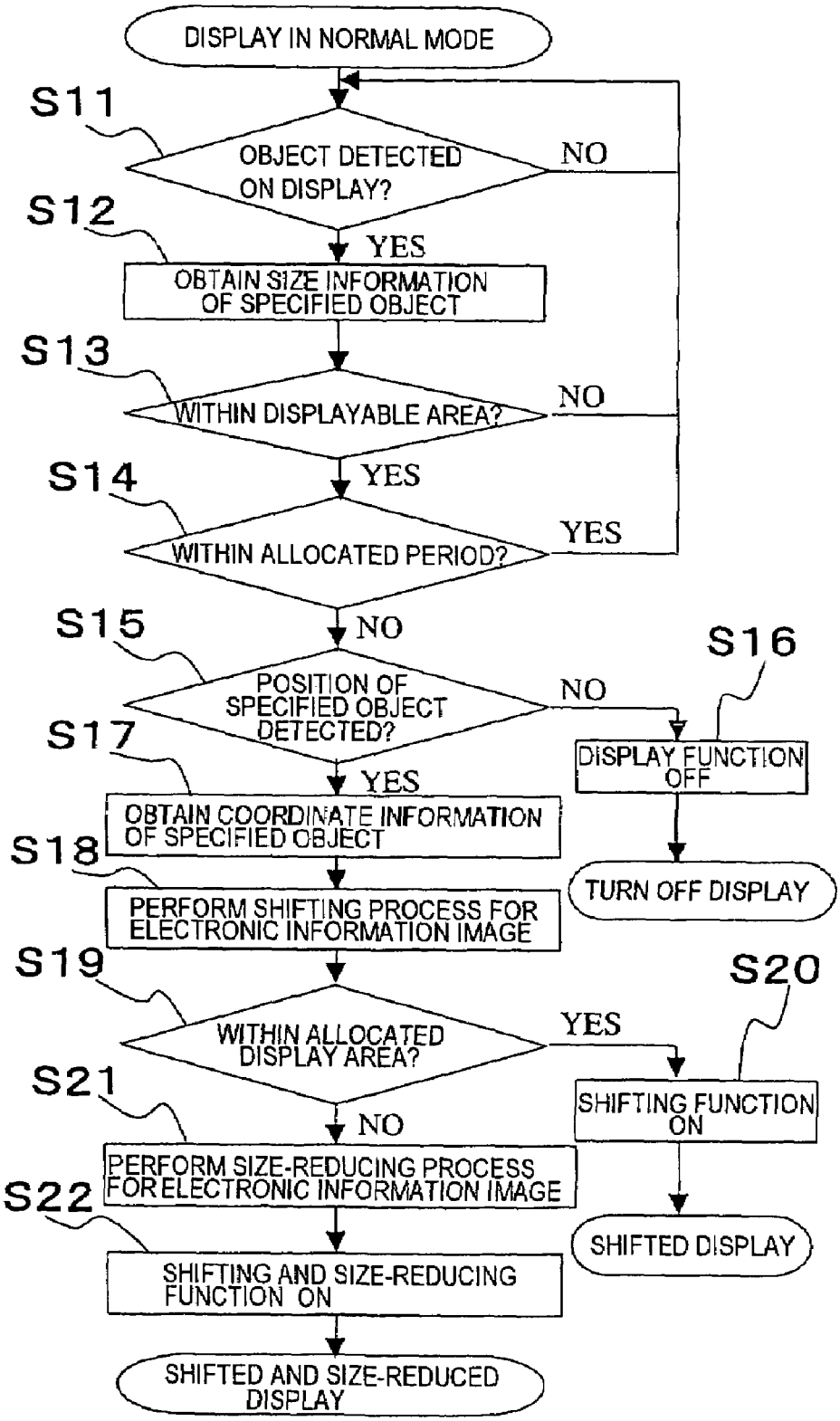
FIG. 6 is a flowchart showing a procedure of display processing based on information detected from coordinates of the display-obstructed area supplied by the coordinate indicator.

FIG. 6 is a flowchart showing a procedure of display restriction processing based on information detected from coordinates of the display-obstructed area supplied by the coordinate indicator.

When the user of the table brings an obstacle into contact with the display surface of the display 5, the display-obstructing factor detecting unit 3 detects an input from the coordinate indicator unit (Step S11), and the CPU 7 obtains the coordinate information of the area including the coordinates indicating the extent of the contact area (Step S12) and, based on the obtained coordinate information, determines whether the contact area of the size indicated by the input from the coordinate indicator unit corresponds to the display-obstructed area or to the area other than the display-obstructed area (Step S13). When the contact area of the size indicated by the input from the coordinate indicator unit corresponds neither to the display-obstructed area nor to the area other than the display-obstructed area, the input from the coordinate indicator unit is determined to be ineffective, and the procedure decides to display in a normal mode.

When it is determined that the contact area of the size indicated by the input from the coordinate indicator unit correspond to the display-obstructed area in Step S13, whether or not the obstacle is placed thereon for a time period longer than a predetermined time period is determined (Step S14).

When it is determined that the obstacle is placed for a time period longer than the predetermined time period and corresponds to the display-obstructed area in Step 514, whether or not the size of the display-obstructed area is within the displayable area is determined based on positional information detected by the input from the coordinate indicator unit (Step S15).

When it is determined that the size of the display-obstructed area exceeds the displayable area based on the information about the position and the size of the display-obstructing obstacle indicated by the coordinate indicator unit, the display function is turned off (Step S16) and hence display is turned off.

When it is determined that the position and the size of the display-obstructing obstacle indicated by the coordinate indicator unit is within the displayable area based on the obtained information, the CPU obtains the coordinate information of the area including the position of the display-obstructing obstacle indicated by the coordinate indicator unit (Step S17), and performs an electronic information image shifting process, which displays the image of the electronic document or menu in the area on the display surface other than the area where the display-obstructing obstacle is in contact (Step S18), and then determines whether or not the electronic information image can be effectively displayed in the area other than the display-obstructed area (Step S19).

When it is determined that the electronic information image can be effectively displayed in the area other than the display-obstructed area in Step S19, a display image shifting function is turned on (Step S20) to shift and display the electronic information image.

When it is determined that the electronic information image cannot be displayed effectively in the area other than the display-obstructed area, the size of the electronic information image is reduced (Step S21), the display image shifting and reducing functions are turned on (Step S22), and the electronic information image is shifted and displayed in a reduced size to complete the procedure.

When the display-obstructing factor detecting unit 3 detects the shifting of the display-obstructing obstacle, the procedure goes back to Step S11, and the same procedure is repeated, as needed. Therefore, as long as there is a displayable area, a display adaptive to the shifting of, and the size of, the obstructing factor, for example, by detecting the display-obstructed area, determining the displayable area in response thereto, and displaying the image in the size adapted to the displayable area, is achieved.

As described thus far, according to the present embodiment, there is provided the display apparatus provided with the display on the top surface of the table, in which when a display-obstructed area is detected, the electronic information image is shifted out of the display-obstructed area and is displayed in reduced size as needed. In addition, a display apparatus in which display can be turned off when the display-obstructed area extends all over the display surface is also achieved.

Second Embodiment

Referring now to FIG. 7 to FIG. 10, a second embodiment of the invention will be described. The system configuration of display apparatus of the present embodiment is such that the display-obstructing obstacle is detected and indicated as an input as in the case of the first embodiment shown in FIG. 2.

Figure 7:
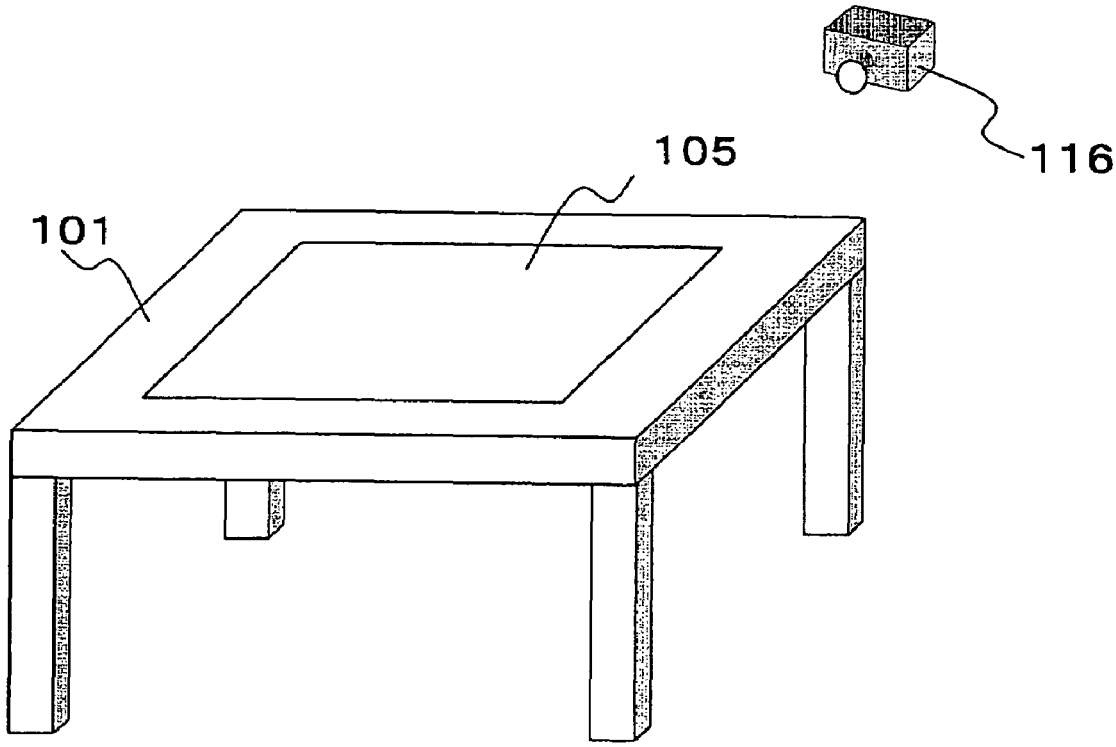
FIG. 7 is an appearance perspective view showing a state in which the user is working at the table using the display apparatus according to a second embodiment of the invention.

FIG. 7 is an appearance perspective view showing a state in which the user is working at the table using the display apparatus according to the present embodiment. In FIG. 7, reference numeral 101 designates a table the upper surface of which is arranged to extend horizontally. The table 101 is provided with a display 105 on the upper surface thereof. A display-obstructing factor detecting unit 103 is provided in the vicinity of the table 101. As input means of the display-obstructing factor detecting unit 103, an image input unit 116 employing, for example, a camera with a CCD sensor is provided permanently.

The portion of the table 101 provided with the display 105 is observed by the aforementioned camera to detect whether or not a display-obstructing obstacle is present, and the camera is arranged for giving control instruction to the display 105. The aforementioned input unit may be a number of infrared ray sensors arranged on the respective sides of the table 101.

Figure 8:
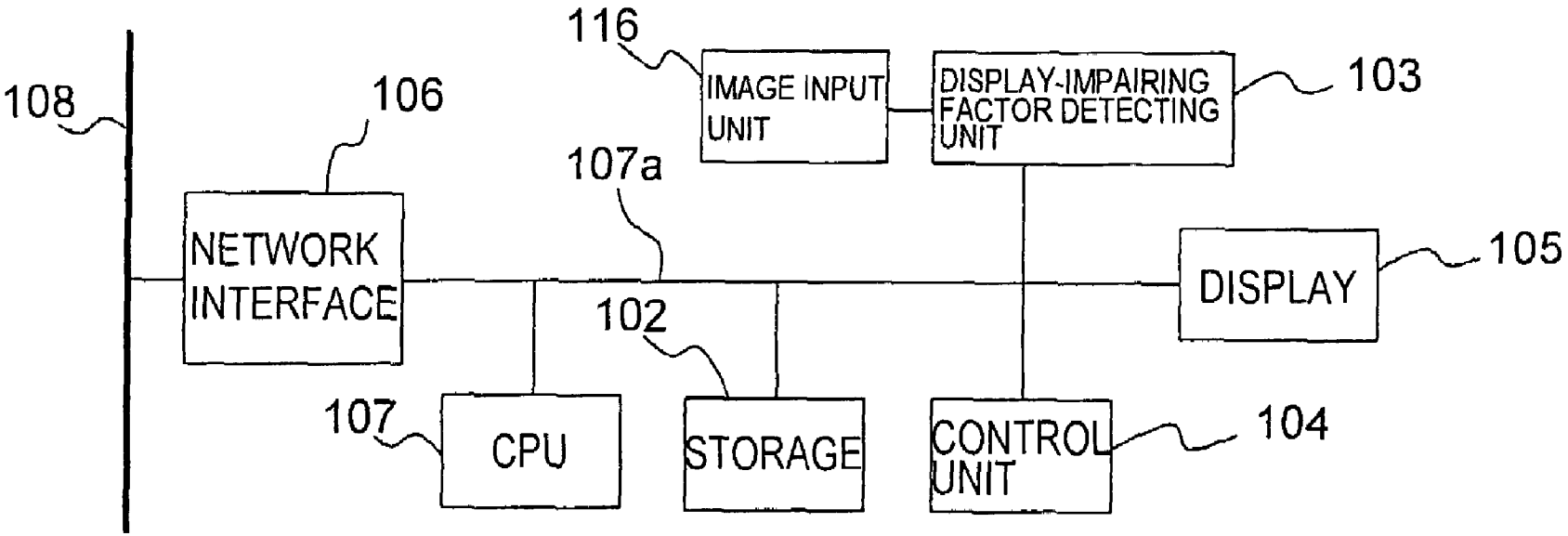
FIG. 8 is a block diagram showing a system configuration of the display apparatus according to the second embodiment of the invention.

FIG. 8 is a block diagram showing a system configuration of the display apparatus according to the present embodiment. In FIG. 8, the display apparatus includes the aforementioned display 105, the image input unit 116 such as a camera with a CCD- or CMOS-type image sensor, the display-obstructing factor detecting unit 103, a control unit 104 having a circuit which can control the image input of the display-obstructing obstacle, a central processing unit (CPU) 107 for controlling the entire apparatus, a storage unit 102, including, for example, a read only memory (ROM) for storing program for performing processing that will be described below in advance, or a random access memory (RAM) for temporality storing image data or the like to be displayed on the display 105, and a network interface 106 for connecting the display apparatus to other devices or networks.

The control unit 104, the CPU 107, the storage unit 102, the display 105, the display-obstructing factor detecting unit 103, the image input unit 116, and the network interface 106 are connected with each other via a bus 107*a*. The control unit 104, the CPU 107, the storage unit 102, and the network interface 106 are provided on the main body (not shown in FIG. 7) of the display apparatus. This display apparatus can be connected to a local area network (LAN) 108 via the network interface 106.

The display-obstructing factor detecting unit 103 is provided on the display surface of the display 105 so as not to obstruct display. The image input unit 116 is connected to the display-obstructing factor detecting unit 103 via a radio circuit and is configured to perform image processing and output detected edges at different frequency. The display-obstructing factor detecting unit 103 can determine the position and the area of the detected display-obstructing obstacle by recognizing the frequency outputted from the image input unit 116. When the user of the table works with the objects placed on the table or has a meal at the table, document displayed on the display 105 can be shifted to the area other than the display-obstructed area on the display 105 described later.

Information files stored in advance and information about files called up from other computers (not shown) are stored in the storage 102 temporarily and displayed in the area other than the display-obstructed area on the display 105, which will be described later, by the CPU 107.

The display-obstructing factor detecting unit 103 starts observation of the state on the table 101 when the power of the apparatus is turned on, and detects on which part of the table 101 the obstacle is placed.

In the above-described configuration, when the user places a dish on the table 101 of the display apparatus and hence the display obstructed area is generated before the user starts eating at the table, the position and the size of the dish which is detected as an obstacle by the display-obstructing factor detecting unit 103, and time elapsed since the dish is placed on the table are transmitted to the CPU 107. The CPU 107 specifies a display area on the display 105 based on the position and the size of the dish and the time elapsed since the dish is placed on the table transmitted from the display-obstructing factor detecting unit 103, and shifts the displayed document thereto.

Figure 9:
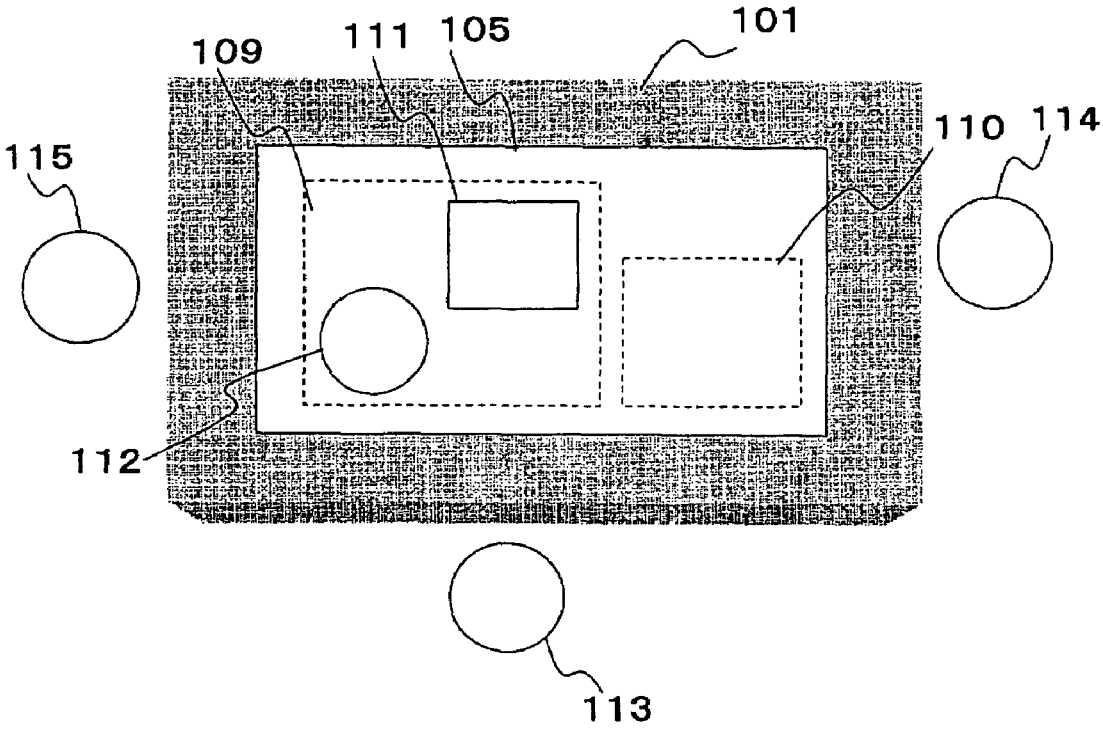
FIG. 9 is an explanatory drawing showing an example of a form of a window opened on a display 105.

FIG. 9 is an explanatory diagram showing an example of a window opened on the display 105. As shown in FIG. 9, above the window opened on the display 105, a camera having an image recognition function for operating display on the window is installed so that the control area for displaying the electronic information image avoiding the display-obstructed area on the table is provided.

In FIG. 9, the number of the users using the table provided with the aforementioned display apparatus is at least one, and the users are having a meal at the table. In FIG. 9, reference numerals 113, 114, and 115 designate the users around the table. The display surface of the display 105 is distinctively identified as a display-obstructed area 109 where the users place the obstacles 111, 112 and as a displayable area 110 where no obstacle is present. The electronic information image is displayed on the display surface of the display 105 based on the identification of these areas, and the positions of the areas can be changed by the process of shifting the electronic information image, avoiding display-obstructing obstacles.

Figure 10:
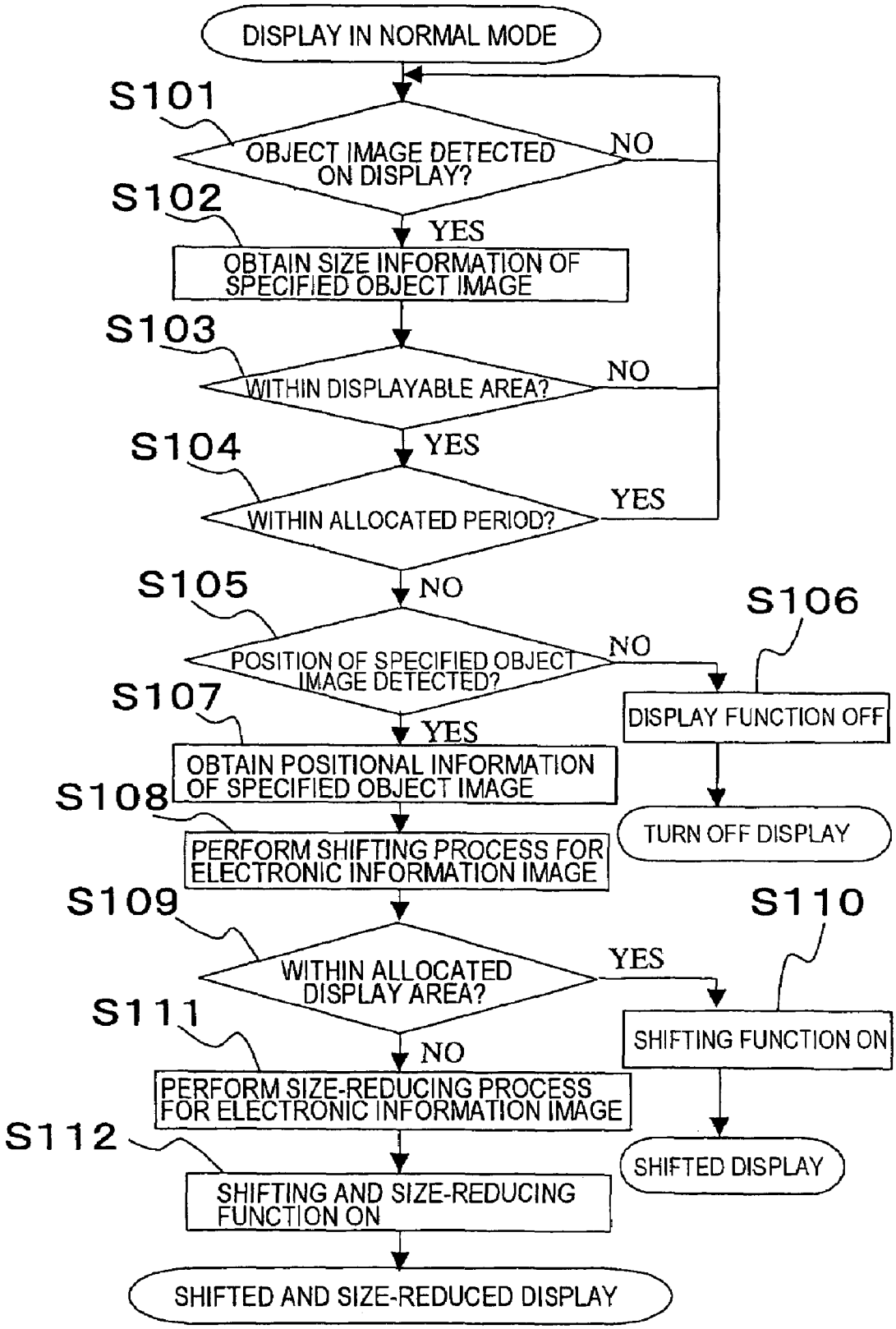
FIG. 10 is a flowchart showing a procedure of identifying the displayable area distinctively in the case where the user of the table is having a meal using the display apparatus of the second embodiment of the invention and a dish is placed on the display surface.

Subsequently, a case in which the users of the table have a meal using the display surface of the table in which the display is built in will be described. FIG. 10 is a flowchart showing the procedure of distinctive identification of the displayable area in the case that the users have a meal and place dishes on the display surface at a restaurant.

The display-obstructing factor detecting unit 103 observes the state of the display surface of the table 101 all the time through the image input unit 116 near the table (Step S101).

In this state, whether or not any obstacle is placed on the display area is determined (Step S102), and, based on the image information, it is determined whether the size of the input image supplied by the image input unit 116 corresponds to the display obstructed area or to the area other than the display obstructed area (Step S103). When the size of the input image supplied by the image input image 116 corresponds neither to the display obstructed area nor to the area other than the display obstructed area, the image input is determined to be ineffective, and the procedure decides to display in a normal mode.

When it is determined that the size of the input image from the image input unit 116 corresponds to the display obstructed area in Step S103, whether or not the obstacle is placed for a time period longer than a predetermined time period is determined (Step S104).

When it is determined that the obstacle is placed for a time period longer than the predetermined time and corresponds to the display obstructed area period in Step S104, whether or not the image detected by the input from the image input unit 116 is within the display area is determined based on positional information detected by the input from the image input unit 116 (Step S105).

When it is determined that the display-obstructing obstacle exceeds the display area based on the information about the position and the size obtained from the input of the image, the display function is turned off (Step S106) and the display is turned off.

When it is determined that the display-obstructing object is within the display area based on the information about the position and the size obtained from the input of the image input unit 116, the CPU obtains the image information of the area including the position of the image detected by the input from the image input unit 116 (Step S107), performs an electronic in formation image shifting process, which displays the image of the electronic document or menu in the area on the display surface other than the area where the display-obstructing obstacle is in contact (Step S108), and then determines whether or not the electronic information image can be effectively displayed in the area other than the display-obstructed area (Step S109).

When it is determined that the electronic information image can be effectively displayed in the area other than the display obstructed area in Step S109, the shifting function of the displayed image is turned on (Step S110) to shift and display the electronic information image.

When it is determined that the electronic information image cannot be effectively displayed in the area other than the display-obstructed area, the size of the electronic information image is reduced (Step S111), the display image shifting and reducing functions are turned on (Step S112), and the electronic information image is shifted and displayed in a reduced size to complete the procedure.

When the display-obstructing factor detecting unit 103 detects the shifting of the display-obstructing obstacle based on a signal from the image input unit 116, the procedure goes back to the step S101, and the same procedure is repeated as needed. Therefore, as long as there is a displayable area, display adaptive to the shifting of and the size of the obstructing factor is achieved, for example, by detecting the display obstructed area, determining the displayable area in response thereto, and displaying the image in the size adapted to the displayable area As described thus far, according to the present embodiment, in order to display the same image as the original electronic information image in the entire display surface of the display 105 except the area other than the display-obstructed area, the state on the table is detected to specify the area other than the display-obstructed area automatically and adequately specified, and to display the image thereon. In addition, even when the display-obstructing obstacle is increased or decreased in number or shifted on the table, resetting of the displayable area can be easily made.

Third Embodiment

Figure 11:
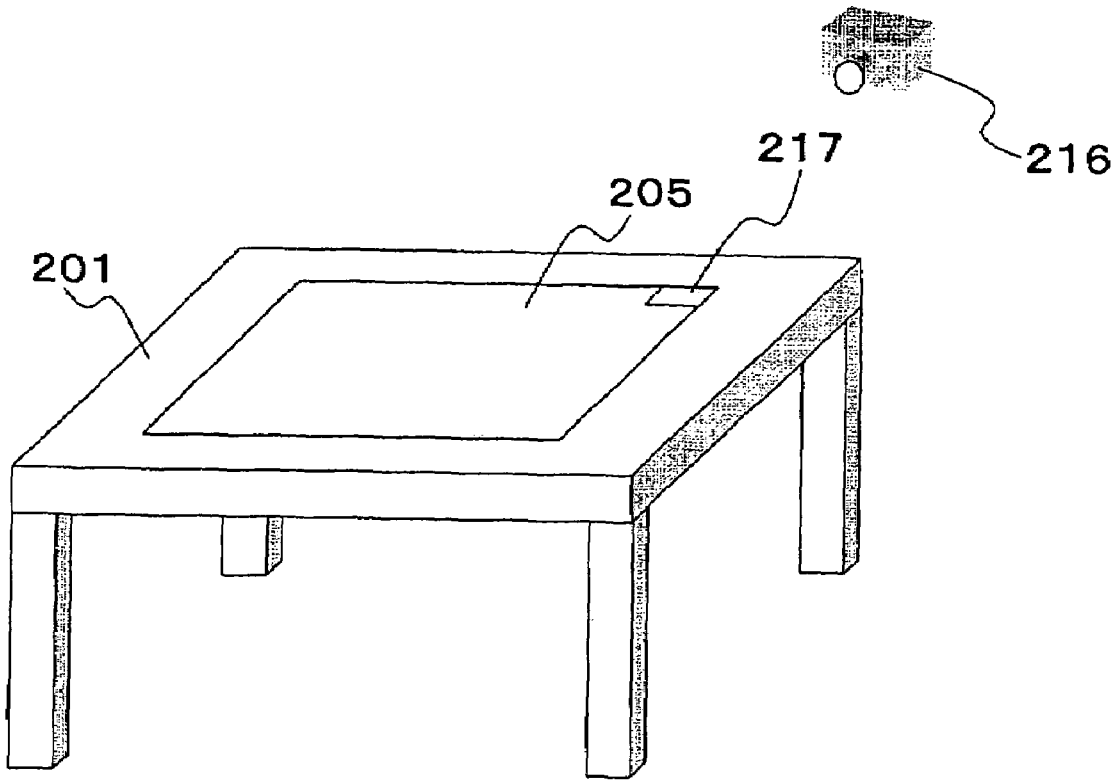
FIG. 11 is an appearance perspective view of a display unit constituting the display apparatus according to a third embodiment of the invention.
Figure 12:
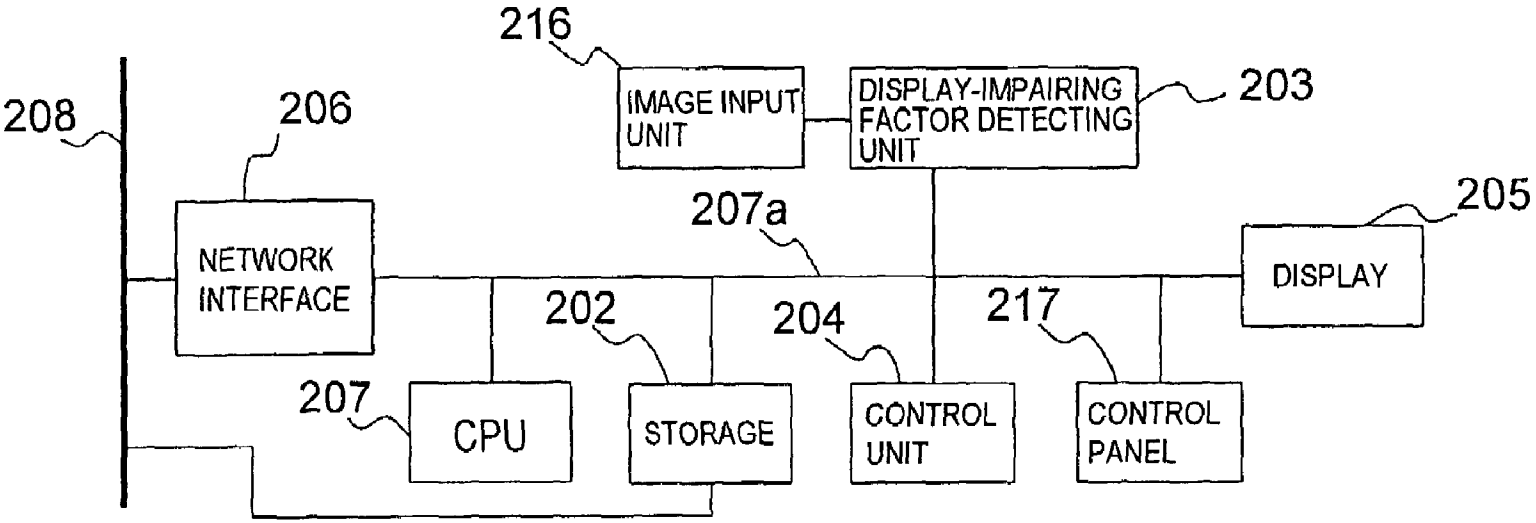
FIG. 12 is a block diagram showing a system configuration of the display apparatus according to the third embodiment of the invention.
Figure 13:
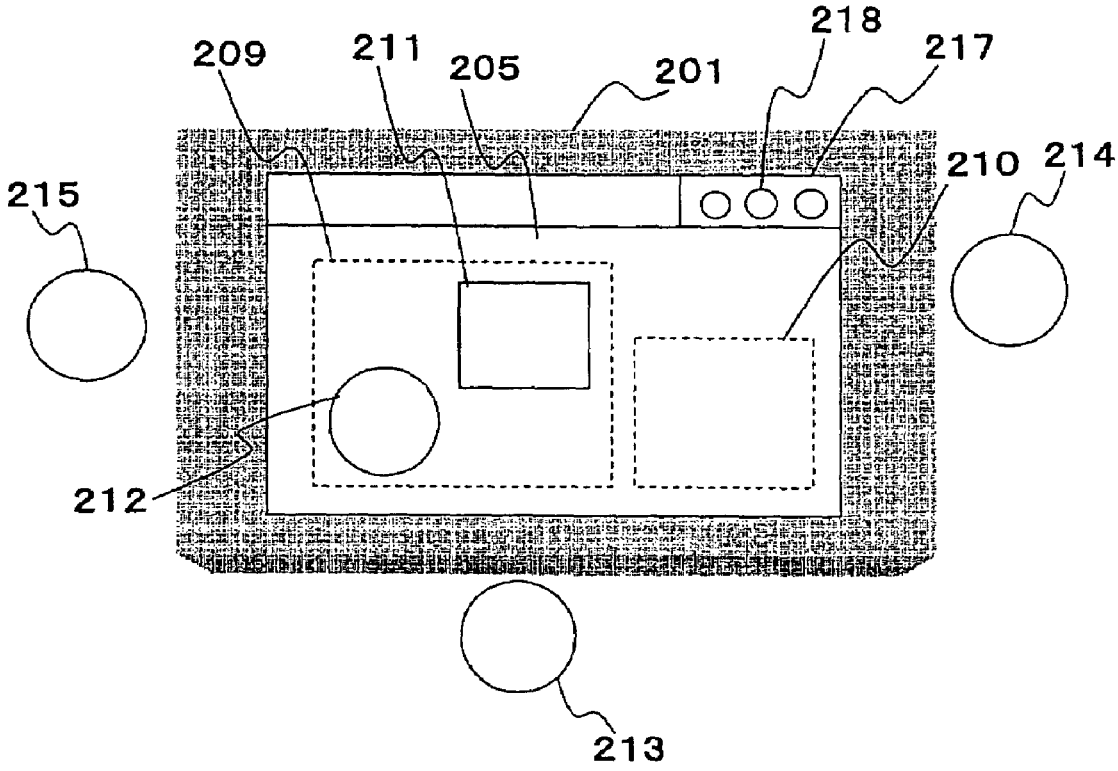
FIG. 13 is an explanatory drawing showing an example in which the contents displayed in the window opened on a display 205 is modified and displayed on the displayable area due to the presence of the display-obstructing factor.

Referring now to FIG. 11 to FIG. 13, a third embodiment of the invention will be described. The system configuration of the display apparatus of the present embodiment is the same as the configuration shown in FIG. 2 in conjunction with the first embodiment or in FIG. 8 in conjunction with the second embodiment.

FIG. 11 is an appearance perspective view showing a state in which the users are having a conversation at a table 201 while having a meal using the display apparatus according to the present embodiment. In FIG. 11, information is displayed on a window opened on a display 205. The window in FIG. 11 is a window which can be used while identifying the area where a dish or dishes that is, display-obstructing obstacles, are placed as a display-obstructed area, and an area other than the display-obstructed area as a displayable area.

FIG. 12 is a block diagram showing a system configuration of the display apparatus which can display the image of the electronic document or the menu on the window opened on the display 205 while modifying the contents of display.

In FIG. 12, the display apparatus includes the aforementioned display 205, a control panel 217 capable of displaying the image of the electronic document or the menu displayed on the aforementioned window with the contents of display changed, an image input unit 216 and an display-obstructing factor detecting unit 203 having a camera with a CCD sensor, a control unit 204 having a circuit that can control input of the image of the display-obstructing obstacle, a central processing unit (CPU) 207 for controlling the entire apparatus, a storage unit 202 including a read only memory (ROM) or the like for storing a program for executing a processing described later in advance, or a random access memory (RAM) or the like for storing image data or the like to be displayed on the display 205 temporarily, and a network interface 206 for connecting the display apparatus to other devices or networks.

The control panel 217, the control unit 204, the CPU 207, the storage unit 202, the display 205, the display-obstructing factor detecting unit 203, the image input unit 216 such as a camera with a CCD- or a CMOS-type image sensor, and the network interface 206 are connected with each other via a bus 207*a*.

The control unit 204, the CPU 207, the storage unit 202, and the network interface 206 are provided in the main body (not shown in FIG. 11) of the display apparatus. This display apparatus can be connected to a local area network (LAN) 208 via the network interface 206.

When a dish or an object is placed on the window on the display 205 and hence the display-obstructed area is generated, the user cannot view the image of the electronic document or the menu which is displayed on the display. However, the present embodiment can be configured in such a manner that when the presence of a display-obstructing obstacle is recognized, the image of the electronic information is shifted to the displayable area and reduced in size for visualizing it as a recommended menu or an additional menu.

As regards a opened window, image information about the electronic document which is prepared in advance is stored in the storage unit 202. The CPU 207 can determine whether or not the image information about the electronic document can be displayed in the displayable area upon reception of an input indicating the presence of a display-obstructing obstacle.

FIG. 13 is an explanatory drawing showing an example in which there are users 213, 214, and 215 of the table and the contents of the window opened on the display 205 are modified and shifted from a display-obstructed area 209 to a displayable area 210 due to the presence of the display-obstructing obstacles 211 and 212. As shown in FIG. 13, there may be provided a control panel 217 as a controlling area in which a menu or buttons 218 for changing the displayed contents are displayed in the upper area of the window opened on the display 205. The control panel 217 having the control area may be provided with a button for closing the window, and a switching button 218 for switching the attribute of the window to recommended information or to additional menu information as image information of the electronic document.

As described thus far, according to the present embodiment, an electronic information image that can convey a different content instead of displaying the same image entirely in the area other than the display-obstructed area on the display surface of the display 205 can be displayed. In addition, like the first embodiment and the second embodiment, the display apparatus which an display the electronic information image in the displayable area on the table, avoiding display-obstructing obstacles, can be realized, and the displayed contents can be modified so that they can be displayed in a desired size at an desired area on the display 205.

Other Embodiments

With implementation of the function of the invention, the invention may be applied to the display apparatus configured of a single device, or of a plurality of devices, or even of a system operated through a network such as LAN.

The object of the invention can be also achieved by a configuration in which a storage media containing a software program code for implementing the functions of the above-described embodiments is provided in the display apparatus or in the display system for allowing a computer (or CPU, MPU) in the apparatus or the system to read out and implement the program code stored in the storage media.

In this case, the program code read out from the storage media by itself realizes a novel function of the invention, and the storage media containing the program code serves as an important element constituting the display apparatus of the invention.

The storage media for providing the program code that can be used here is, for example, a floppy disk, a hard disk, an optical disk, a magnetic optical disk, a CD-ROM, a CD-R, a magnetic tape, a non-volatile memory card, and a ROM.

In addition to the case in which the functions of the above-described embodiments are realized by implementing the program code read out by the computer, the case in which the functions of the above-described embodiments are realized by an OS operated in the computer which performs part or all of the actual processing based on the instruction of the program code is also included.

Furthermore, the invention includes the case in which the functions of the above-described embodiments are realized by writing the program code read out from the storage media into a memory provided in a feature expansion board inserted into the computer or a feature expansion unit connected to the computer, and then performing part or all of the actual processing by the CPU provided in the feature expansion board or the feature expansion unit based on the instruction of the program code.

As described above, even when a display-obstructing obstacle is placed on the display apparatus, the display-obstructed area where the display-obstructing obstacle is present can be detected, and the area containing the displayed contents can be shifted to and displayed in the displayable area other than the display-obstructed area. Therefore, the displayed contents which are to be covered by the display-obstructing obstacle unless being shifted to the displayable area can be displayed in the area which is visible from the user.

Furthermore, since the displayed contents can be reduced in size even when the displayable area is smaller than the area which has been displayed before, the image of a size which might have been covered by the display-obstructing obstacle unless being reduced in size can be displayed.

When the detecting unit detects the display-obstructed area, for example, the contents of the electronic document can be modified and displayed depending on the size of the display-obstructed area.

When the time period of the presence of the display-obstructed area detected by the detecting unit provided in the display screen is shorter than the reference value, the area to display the contents therein is not shifted. Therefore, the area of the displayed contents is prevented from being shifted uselessly due to the presence of the display-obstructing factor for an ignorable short period. Therefore, unintended shifting of the displayed contents (image) can be prevented.

When the area of the display-obstructed area detected by the detecting unit is smaller than the reference value, the shifting of the area of the displayed contents is not performed. Therefore, useless shifting of the area of the displayed contents due to the presence of the display-obstructed factor of an ignorable small area can be prevented.

Furthermore, when the area of the display-obstructed area detected by the detecting unit is larger than the reference value, the displayed contents are deleted. Therefore, useless display in the display area covered by the display-obstructed area can be prevented.

In addition, even when a display-obstructing obstacle is placed on the display apparatus, the display-obstructed area in which the display-obstructing obstacle is present is detected, and the area of the displayed contents can be shifted to and displayed in the displayable area other than the display-obstructed area. Therefore, the displayed contents covered by the display-obstructing obstacle can be displayed at the position which is visible from the user.

Even when the displayable area is smaller than the area of the displayed contents before shifting, the area of the displayed contents may be reduced in size so that the displayed contents covered by the display-obstructing obstacle can be displayed.

When the detecting unit detects the display-obstructed area, the electronic document can be displayed by modifying the contents depending on the size of the display-obstructed area.

When the time period of the presence of the display-obstructed area detected by the detecting unit on the display screen is shorter than the reference value, shifting of the area of the displayed contents is not performed. Therefore, useless shifting of the area of the displayed contents due to the existence of the display-obstructing factor for an ignorable short period can be prevented.

When the area of the display-obstructed area detected by the detecting unit is smaller than the reference value, shifting of the area of the displayed contents is not performed. Therefore, useless shifting of the area of the displayed contents due to the existence of the display-obstructing factor of an ignorable small area is prevented.

When the area of the display-obstructed area detected by the detecting unit is larger than the reference value, the displayed contents is deleted. Therefore, useless display in the display area covered by the display-obstructed area can be prevented.

When the display-obstructing factor detecting unit detects the shifting of the display-obstructing obstacle, the display apparatus of the invention can detect the display-obstructed area again, specify the displayable area and display the image in the displayable area as needed. Therefore, so far as there exists any displayable area, display adaptive to the shifting of and the size of the obstructing factor is achieved, for example, by detecting the displayable area, and displaying the image therein.

As described thus far, according to the invention, even when the display-obstructing obstacle is placed on the display apparatus, the display-obstructed area where the display-obstructing factor is present is detected, and the area of displayed contents can be shifted to and displayed in the displayable area other than the display-obstructed area. Therefore, the display contents covered by the display-obstructing obstacle can be displayed in the area which is visible from the user.

What is claimed is:

1. A display apparatus comprising:

a display unit having a display surface;

a detecting unit for detecting a display-obstructed area where a display-obstructing factor is present on the display surface;

a determination unit for determining whether an extent of the display-obstructed area is larger than a reference value, a shifting unit for shifting the area of displayed contents to a displayable area other than the display-obstructed area according to the determination of the determination unit; and a display control unit for displaying the displayed contents which have been shifted by the shifting unit to the area other than the display-obstructed area.

2. A display apparatus according to claim 1, further comprising a size-reducing unit for reducing the area of displayed contents when the displayable area is smaller than the area of the displayed contents before being shifted.

3. A display apparatus according to claim 1, wherein shifting of the area of the displayed contents is not carried out by the shifting unit when the time period of presence of the display-obstructed area detected by the detecting unit is shorter than a reference value.

4. A method of controlling a display apparatus for effecting a display in the area on the display apparatus in which no display-obstructing factor is present, comprising the steps of:

detecting a display-obstructed area where a display-obstructing factor is present when there is the display-obstructing factor placed on the display apparatus;

determining whether an extent of the display-obstructed area is larger than a reference value, shifting the area of displayed contents to a displayable area other than the display-obstructed area according to the determination; and displaying the area of the displayed contents which have been shifted by the shifting unit in the area other than the display-obstructed area.

5. A method of controlling a display apparatus according to claim 4, wherein the area of the displayed contents is reduced in size when the displayable area is smaller than the area of the displayed contents before being shifted.

6. A method of controlling a display apparatus according to claim 4, wherein shifting of the area of the displayed contents is not carried out when the time period of the presence of the detected display-obstructed area is shorter than a reference value.

7. A method of controlling a display apparatus comprising the steps of:

displaying displayed contents on a display surface;

detecting a display-obstructing factor existing on the display surface;

determining whether an extent of the display-obstructed area is larger than a reference value; and specifying a displayable area according to the display-obstructed area based on the determination and shifting and displaying the displayed contents in the displayable area.

* * * * *

UNITED STATES PATENT AND TRADEMARK OFFICE

CERTIFICATE OF CORRECTION

PATENT NO. : 7,250,942 B2
APPLICATION NO. : 10/793790
DATED : July 31, 2007
INVENTOR(S) : Satoshi Mitsumura et al.

It is certified that error appears in the above-identified patent and that said Letters Patent is hereby corrected as shown below:

COLUMN 1:

Line 31, “searching for.” should read --searching for said screen.--.
Line 66, “shifting u nit” should read --shifting unit--.

COLUMN 4:

Line 8, “all the user” should read --all the users--.
Line 21, “temporality” should read --temporarily--.

COLUMN 6:

Line 5, “correspond” should read --corresponds--.

COLUMN 7:

Line 5, “display” should read --a display--.
Line 39, “temporality” should read --temporarily--.

COLUMN 9:

Line 17, “in formation” should read --information--.
Line 45, “area” should read --area.--.

UNITED STATES PATENT AND TRADEMARK OFFICE

CERTIFICATE OF CORRECTION

PATENT NO. : 7,250,942 B2
APPLICATION NO. : 10/793790
DATED : July 31, 2007
INVENTOR(S) : Satoshi Mitsumura et al.

It is certified that error appears in the above-identified patent and that said Letters Patent is hereby corrected as shown below:

COLUMN 11:

Line 10, “an display” should read --can display--.

Signed and Sealed this

Twenty-seventh Day of January, 2009

JOHN DOLL
*Acting Director of the United States Patent and Trademark Office*